US008541948B2

(12) United States Patent
Konrad et al.

(10) Patent No.: US 8,541,948 B2
(45) Date of Patent: Sep. 24, 2013

(54) OPERATING DEVICE AND METHOD FOR OPERATING AT LEAST ONE HG LOW PRESSURE DISCHARGE LAMP

(75) Inventors: Armin Konrad, Grossaitingen (DE); Roger Hunt, Medfield, MA (US); Martin Zachau, Geltendorf (DE); Ralph Hoeck, Friedberg (DE)

(73) Assignee: Osram Gesellschaft mit Beschraenkter Haftung, Munich (DE)

( * ) Notice: Subject to any disclaimer, the term of this patent is extended or adjusted under 35 U.S.C. 154(b) by 227 days.

(21) Appl. No.: 13/132,081

(22) PCT Filed: Dec. 1, 2009

(86) PCT No.: PCT/EP2009/066153

§ 371 (c)(1), (2), (4) Date: Jun. 1, 2011

(87) PCT Pub. No.: WO2010/063719

PCT Pub. Date: Jun. 10, 2010

(65) Prior Publication Data

US 2011/0234103 A1 Sep. 29, 2011

(30) Foreign Application Priority Data

Dec. 5, 2008 (DE) ..... 10 2008 060 778

(51) Int. Cl.

| | |
|---|---|
| ***H05B 41/36*** | (2006.01) |
| ***H01J 61/52*** | (2006.01) |
| ***H01J 1/63*** | (2006.01) |

(52) U.S. Cl.

USPC ..... 315/117; 315/134; 313/486; 313/487; 313/640; 313/642

(58) Field of Classification Search

USPC ..... 313/22, 485–487, 573, 565, 634, 313/636, 637, 640, 642, 643; 315/117, 134, 315/56, 277, 291

See application file for complete search history.

(56) References Cited

U.S. PATENT DOCUMENTS

| | | | | |
|---|---|---|---|---|
| 4,005,332 | A | | 1/1977 | Gallo et al. |
| 4,449,821 | A | | 5/1984 | Lee |
| 4,529,912 | A | | 7/1985 | Northrup et al. |
| 4,533,854 | A | | 8/1985 | Northrup |
| 4,746,832 | A | * | 5/1988 | Grossman et al. ..... 313/22 |
| 4,978,891 | A | | 12/1990 | Ury |

(Continued)

FOREIGN PATENT DOCUMENTS

| | | |
|---|---|---|
| CN | 1306673 A | 8/2011 |
| DE | 4011951 A1 | 10/1990 |
| EP | 1259100 A2 | 11/2002 |

OTHER PUBLICATIONS

International Search Report of PCT/EP2009/066153 dated Jun. 11, 2010.

*Primary Examiner* — Vibol Tan

(57) ABSTRACT

An operating device for operating at least one Hg low-pressure discharge lamp which has a first and a second electrode coil may include a unit for providing a variable that is correlated with the Hg vapor pressure in the at least one Hg low-pressure discharge lamp comprises at least one unit for capturing emission spectra of at least specifiable spectral ranges, wherein the unit for capturing emission spectra may include at least one light receiving unit which is arranged in the beam path of the at least one Hg low-pressure discharge lamp.

17 Claims, 3 Drawing Sheets

(56) References Cited

U.S. PATENT DOCUMENTS

| | | | | |
|---|---|---|---|---|
| 5,461,285 | A | 10/1995 | Schleijpen et al. | |
| 5,619,041 | A * | 4/1997 | Hoffmann et al. | 250/373 |
| 5,828,178 | A | 10/1998 | York et al. | |
| 5,834,908 | A | 11/1998 | Boland et al. | |
| 6,031,241 | A | 2/2000 | Silfvast et al. | |
| 6,479,947 | B1 * | 11/2002 | Newsome | 315/277 |
| 6,693,382 | B2 | 2/2004 | Little et al. | |
| 6,791,271 | B2 * | 9/2004 | Horiuchi et al. | 315/56 |
| 7,116,055 | B2 | 10/2006 | Waymouth et al. | |
| 7,334,916 | B2 * | 2/2008 | Doll et al. | 362/231 |
| 7,468,584 | B2 * | 12/2008 | Tsukamoto et al. | 313/637 |
| 7,876,052 | B2 * | 1/2011 | Hollstein et al. | 313/634 |
| 7,884,535 | B2 * | 2/2011 | Juestel et al. | 313/486 |
| 2006/0202641 | A1 | 9/2006 | Buij et al. | |
| 2007/0052664 | A1 | 3/2007 | Hirakata et al. | |

* cited by examiner

OPERATING DEVICE AND METHOD FOR OPERATING AT LEAST ONE HG LOW PRESSURE DISCHARGE LAMP

RELATED APPLICATIONS

The present application is a national stage entry according to 35 U.S.C. §371 of PCT application No.: PCT/EP2009/066153 filed on Dec. 1, 2009, which claims priority from German application No.: 10 2008 060 778.9 filed on Dec. 5, 2008.

TECHNICAL FIELD

Various embodiments relate to an operating device for operating at least one Hg low-pressure discharge lamp which has a first and a second electrode coil, including an input for connecting a supply voltage, an output for connecting the at least one Hg low-pressure discharge lamp, a unit for providing a variable that is correlated with the Hg vapor pressure in the Hg low-pressure discharge lamp, a microcontroller which is coupled to said unit for providing the variable that is correlated with the Hg vapor pressure and to the output of the operating device, and is configured to provide at the output a signal for operating the at least one Hg low-pressure discharge lamp, wherein the signal is characterized by at least one lamp operating parameter which is dependent on the variable that is correlated with the Hg vapor pressure. Various embodiments further relate to a corresponding method for operating at least one Hg low-pressure discharge lamp.

BACKGROUND

The prior art discloses determining the Hg vapor pressure of a Hg low-pressure discharge lamp, in order that this can be taken into consideration when controlling the Hg low-pressure discharge lamp. In this case, the Hg vapor pressure is calculated indirectly from the temperature by means of attaching a temperature sensor to the lamp bulb or to the light. The temperature sensor is preferably arranged in the vicinity of or directly at the so-called cold spot. In the case of amalgam lamps, the temperature sensor is preferably attached in the vicinity of the amalgam base.

For the purpose of control, the temperature sensor is connected to a control unit, e.g. a so-called DALI unit, which forwards the parameters required for the lamp operation to an electronic ballast resistor. The control unit may also be integrated directly into the electronic ballast resistor.

However, the use of a temperature sensor has the following disadvantages:

If the cold spot is situated at a distinct position, a temperature sensor may be attached at this position using a suitable heat-conductive paste, for example. Although the temperature at this position may be determined thus, and therefore the prevailing Hg vapor pressure may be deduced indirectly after suitable calibration, such a measuring system nonetheless involves an undesired time lag due to heat conductivity and heat capacities of the temperature sensor and the discharge tube. Determination of the Hg vapor pressure is therefore delayed.

Secondly, the exact location of the cold spot may vary depending on the operating conditions of an Hg low-pressure discharge lamp: particularly critical are applications that are exposed to temporary drafts, applications at very low outside temperatures, e.g.<−20° C., or applications in which the lamps are operated dynamically, in particular where states of low dimming, for example>90% nominal power consumption, alternate with states of high dimming, for example<10% nominal power consumption. Depending on the initial state and the time duration of the dimming sequence, the location of the cold spot may move. Merely by way of example, reference is made to so-called T5 lamps (featuring cold-spot technology), in which the cold spot moves from the original location at the edge of the socket to the center of the lamp when the discharge tube cools. Without knowing the location of the cold spot, the Hg vapor pressure cannot be precisely determined, and it is therefore impossible to specify reliable or correct lamp operating parameters. Consequently, reliable operation of the lamp cannot be guaranteed.

SUMMARY

Various embodiments provide an operating device and a method which allow reliable operation of an Hg low-pressure discharge lamp depending on the Hg vapor pressure.

The present invention is based on the finding that the Hg vapor pressure may be deduced from the emission spectrum of an Hg low-pressure discharge lamp. The emission spectrum may be determined in a contactless manner, such that the influence of heat conductivity and heat capacities is excluded. It is therefore also possible to exclude any time delay other than the processing time of the components involved. Furthermore, the emission spectrum can be recorded at locations that are largely unaffected by the Hg vapor pressure. In other words, it is not necessary to vary the location at which the emission spectrum is recorded—in contrast with the calculation of the temperature of the cold spot due to movement of the cold spot. Instead, the location can be permanently selected.

As a result, the Hg vapor pressure can be calculated quickly and correctly, such that reliable operation of the lamp can be guaranteed.

It is particularly advantageous that the response time of the procedure according to the invention is shorter than in systems featuring a temperature sensor. This means that operating parameters having greater reliability can be calculated for the Hg low-pressure discharge lamp. For amalgam lamps, the knowledge of the dependency of the amalgam vapor pressure on a temperature reference was necessary in the prior art, but this is not required here. The unit for capturing the emission spectrum may therefore be permanently attached to the light. When the lamp is changed (the lamp being installed in the light), no additional wiring work is necessary, thus differing from a temperature sensor which is connected to the lamp.

The variable provided by the unit is therefore assigned by the microcontroller to an Hg vapor pressure in the Hg low-pressure discharge lamp. In response to this Hg vapor pressure, the microcontroller outputs a signal for operating the Hg low-pressure discharge lamp, wherein said signal governs at least one lamp operating parameter for controlling the Hg low-pressure discharge lamp, by means of which parameter it is possible to influence the Hg vapor pressure and the variable that is correlated therewith.

The at least one lamp operating parameter preferably relates to the heating, in particular the preheating and/or continuous heating and/or additional heating of at least one electrode coil of the at least one Hg low-pressure discharge lamp. The efficiency of the Hg low-pressure discharge lamp can therefore be optimized, thereby allowing particularly resource-saving operation of the Hg low-pressure discharge lamp.

The microcontroller is preferably configured to determine the emission intensities of specifiable Hg lines and/or Ar lines and/or luminophore emission lines and/or noble gas lines, in particular Kr and/or Xe lines, and to analyze these at least for the purpose of determining the Hg vapor pressure of the at least one Hg low-pressure discharge lamp. As described in greater detail below, different emission intensities or their ratios to each other allow different indications. Different emission intensities can be relevant in the context of different environmental conditions. If one and the same microprocessor is configured to analyze the widest possible range of emission intensities, most or even all of the possible indications can be obtained and taken into consideration when operating the Hg low-pressure discharge lamp. Hg emission spectra are more difficult to analyze in the case of very low environmental temperatures, in particular. Therefore Ar lines are preferably analyzed in such temperature ranges.

The microcontroller is particularly preferably configured to determine the ratio of the emission intensity of the Hg line at 405 nm and/or 436 nm and/or 546 nm and/or 579 nm and/or the Ar line at 764 nm, and to analyze these at least for the purpose of determining the Hg vapor pressure of the at least one Hg low-pressure discharge lamp. These emission intensities are particularly distinctive in this case, and therefore indications relating to the Hg vapor pressure can be obtained particularly easily and reliably.

The microprocessor is preferably configured in particular to determine the ratio of the emission intensities of the Hg line at 436 nm and the Hg line at 405 nm, and to analyze these at least for the purpose of determining the Hg vapor pressure of the at least one Hg low-pressure discharge lamp.

The unit for capturing emission spectra preferably includes a spectrometer. A diode array spectrometer is particularly preferred in this context.

In a preferred embodiment of the present invention, the unit for capturing emission spectra includes at least one sensor which is suitable for at least one specifiable spectral range. In other words, a spectrometer is not essential; rather, a spectral sensor that is configured at least to capture the relevant emission spectra is sufficient. It is therefore possible to implement the present invention particularly inexpensively.

The unit for capturing emission spectra can be connected to the at least one Hg low-pressure discharge lamp. However, as mentioned above, it can also be merely connected to the light in which the Hg low-pressure discharge lamp is installed.

The first-cited variant has the advantage that the location at which the emission spectrum is received can be specified with particular precision, but incurs the disadvantage of an additional wiring effort when a lamp is changed. In the case of the second-cited variant, the wiring effort is eliminated but the location at which the emission spectrum is received cannot be specified beforehand quite as precisely as in the case of the first-cited variant.

The microcontroller is particularly preferably configured to provide a signal, at the output of the operating device, for effecting an end-of-life shutdown. The occurrence of the end of the service life of the lamp can likewise be detected by means of analyzing specific emission intensities. It is thus particularly easy to recognize the end of the lamp service life in that the Ar line increases at 764 nm while the Hg intensity decreases generally. It is therefore possible to detect and shut down low-Hg lamps whose basic gas discharge persists, in order to avoid an unnecessary waste of energy.

The microcontroller can be further configured to activate at least one component that is relevant for the heat management of the at least one Hg low-pressure discharge lamp, in particular a Peltier element, a fan, a heating unit, or a cooling unit, depending on the Hg vapor pressure of the at least one Hg low-pressure discharge lamp. The temperature of the lamp can therefore be monitored and governed in a particularly simple way, such that the lamp can be operated in a preferred temperature range. As a result of this, the service life of the lamp can be extended, for example.

The unit for providing a variable that is correlated with the Hg vapor pressure in the at least one Hg low-pressure discharge lamp is particularly preferably configured to provide a variable that is correlated with the Hg vapor pressure of a plurality of Hg low-pressure discharge lamps, wherein an optical waveguide which is arranged in the beam path of the relevant Hg low-pressure discharge lamp is provided in each case as a light receiving unit for each Hg low-pressure discharge lamp, wherein each optical waveguide is coupled to the unit for capturing emission spectra, in particular via a multiplexer. This allows the operation of a plurality of Hg low-pressure discharge lamps using only a single unit for capturing emission spectra. A particularly inexpensive implementation is therefore possible.

The preferred embodiments and their advantages relating to an operating device according to the invention are valid correspondingly in relation to the inventive method where applicable.

A particularly preferred development of the method according to the invention allows the prediction of a spectral locus shift for a specific Hg low-pressure discharge lamp. This knowledge is particularly important for applications in the field of stage lighting, daylight control, for dimming, as well as in zones in which the temperature can be influenced by an air conditioning system. In this context, the determination of the spectral locus and the prediction of its shift using an RGB sensor are already known from the prior art. However, the present invention allows both the Hg vapor pressure calculation and the prediction of a spectral locus shift to be performed using a single sensor, specifically a spectral sensor, whereas two types of sensor, specifically a temperature sensor and an RGB sensor, were required for this purpose in the prior art.

The following steps are performed during the preferred development: determine a first variable which is correlated with the Hg vapor pressure of a first Hg low-pressure discharge lamp at time point t1 using the temperature T1 and the voltage U1 at the output of the operating device; determine (in particular measure) at least one variable which is correlated with the spectral locus using the first variable that was correlated with the Hg vapor pressure of the first Hg low-pressure discharge lamp, at the time point t1 using the temperature T1 and the voltage U1 at the output of the operating device; determine the variable which is correlated with the Hg vapor pressure of a second Hg low-pressure discharge lamp at the time point t2 using the temperature T2 and the voltage U2 at the output of the operating device; and finally compute at least one variable which is correlated with the spectral locus of the first Hg low-pressure discharge lamp at the time point t2 using the temperature T2 and the voltage U2, from the corresponding variable which was correlated with the spectral locus of the first Hg low-pressure discharge lamp at the time point t1 using the temperature T1 and the voltage U1, from the first variable which was correlated with the Hg vapor pressure of the first Hg low-pressure discharge lamp at the time point t1 using the temperature T1 and the voltage U1, and from the second variable which was correlated with the Hg vapor pressure of the second Hg low-pressure discharge lamp at the time point t2 using the temperature T2 and the voltage U2.

The previously mentioned microprocessor can obviously be configured to carry out these method steps.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 1:
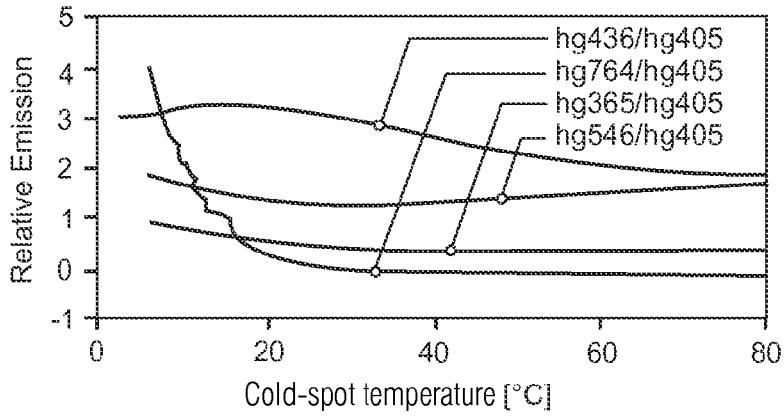
FIG. 1 shows the emission intensities of various Hg lines relative to the Hg line at 405 nm depending on the temperature of the cold spot.

FIG. 1 shows the profile of the Hg emission spectra at 436, 764, 365 and 546 nm relative to the Hg emission spectrum at 405 nm depending on the temperature at the cold spot of an Hg low-pressure discharge lamp. It is clearly evident that significant changes occur over the temperature range, and therefore the temperature and hence the Hg vapor pressure of the Hg low-pressure discharge lamp may conversely be inferred from a specific value of the ratio of two emission lines. The ratio of the emission intensity at 436 nm to the intensity of the Hg line at 405 nm is obviously particularly suitable.

Figure 2:
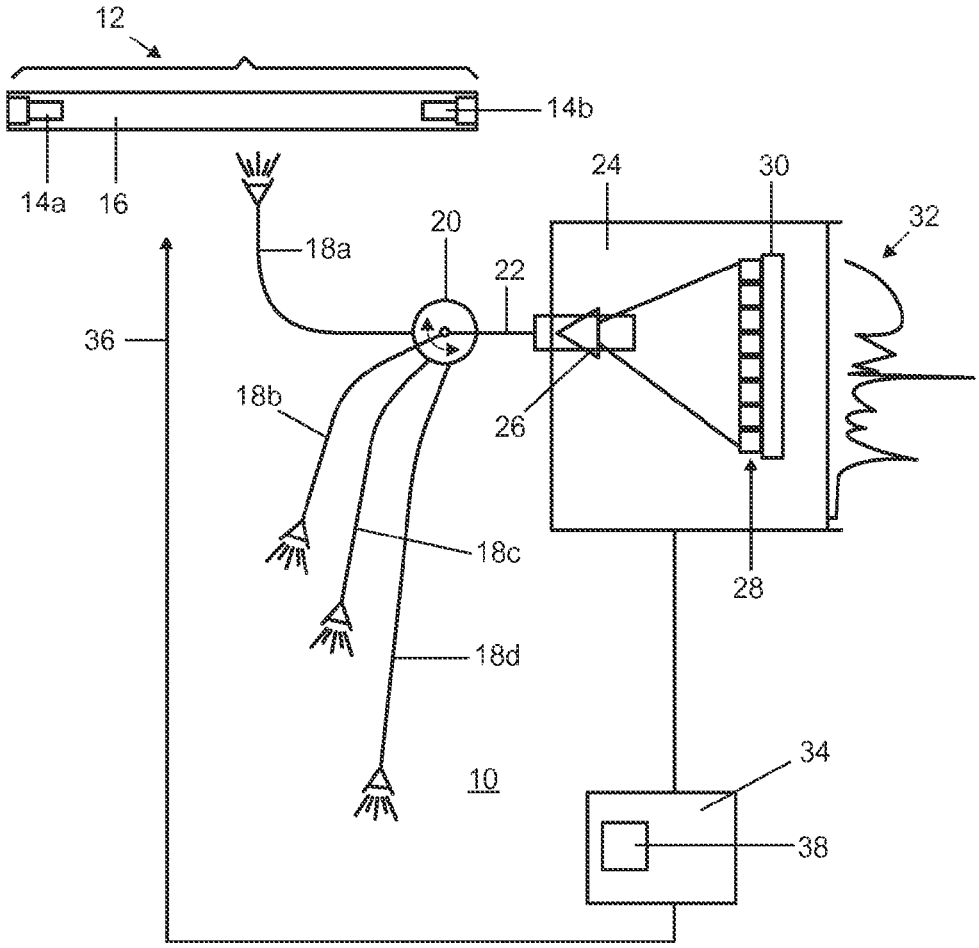
FIG. 2 shows a schematic illustration of the structure of an operating device according to the invention.

FIG. 2 shows a schematic illustration of the structure of an operating device 10 according to the invention. An exemplary Hg low-pressure discharge lamp 12 is shown, wherein a first electrode 14*a* and a second electrode 14*b* are recognizable, being arranged opposite each other in a lamp bulb 16. The entry opening of a first optical waveguide 18*a* is arranged approximately centrally relative to the lamp bulb 16, such that light emitted by the Hg low-pressure discharge lamp 12 enters the optical waveguide 18*a*. In this case, the optical waveguide 18*a* is preferably installed in the light (not shown) in which the Hg low-pressure discharge lamp 12 is arranged. Further optical waveguides 18*b* to 18*d* can be arranged correspondingly relative to further Hg low-pressure discharge lamps. The optical waveguides 18*a* to 18*d* are coupled to an interlinking point 20 comprising a line 22 that is connected to the input of a spectrometer 24. A multiplexer is provided at the interlinking point 20, in order to couple the respectively desired optical waveguide 18*a* to 18*d* to the line 22, this being preferably designed as an optical waveguide. The spectrometer 24 comprises a prism or an optical grating 26 for the purpose of breaking down the light that is fed in via the optical waveguide 22 into its spectral components. Arranged opposite the prism is a photodiode array 28 which is coupled to a line scan camera 30, said line scan camera featuring 1024 pixels in a row.

The result spectrum 32 is produced as a result, being schematically plotted over the wavelength in this case. Said result spectrum 32 is supplied to an electronic ballast resistor 34, which includes a microcontroller 38 for analyzing the emission intensities and in particular the ratios thereof. An essential point of the analysis relates to the calculation of the Hg vapor pressure which, in accordance with control rules that are stored in the microcontroller, is converted into at least one lamp operating parameter for activating the Hg low-pressure discharge lamp 12, as illustrated schematically by the arrow 36.

Figure 3:
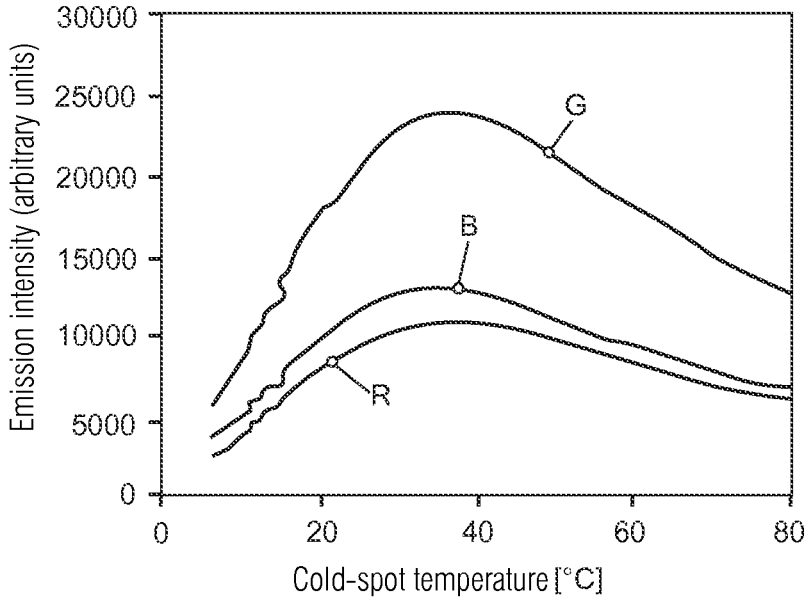
FIG. 3 shows the profile of the emission intensities for the colors red, green and blue depending on the temperature of the cold spot.

FIG. 3 shows the profile of the emission intensities for green G, blue B and red light R depending on the temperature at the cold spot of an Hg low-pressure discharge lamp. A significant dependency on the temperature is clearly evident.

Figure 4:
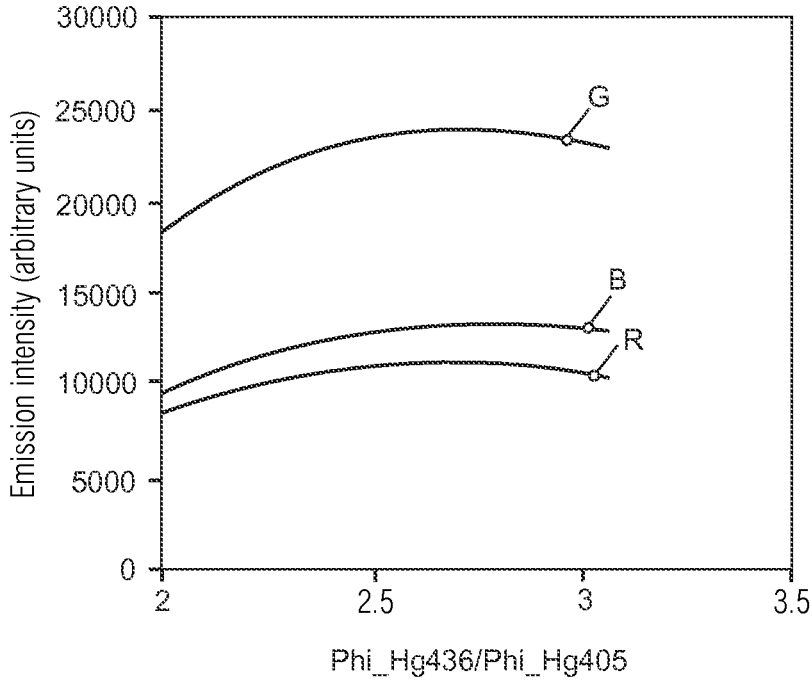
FIG. 4 shows the profile of the emission intensities for red, green and blue light depending on the ratio of the intensities of the Hg line at 435 nm and the Hg line at 404 nm.

FIG. 4 shows a schematic illustration of the dependency of the emission intensities for green G, blue B and red light R depending on the ratio of the emission intensity of the Hg line at 436 nm to the emission intensity of the Hg line at 405 nm. A relevant dependency is likewise established here.

Figure 5:
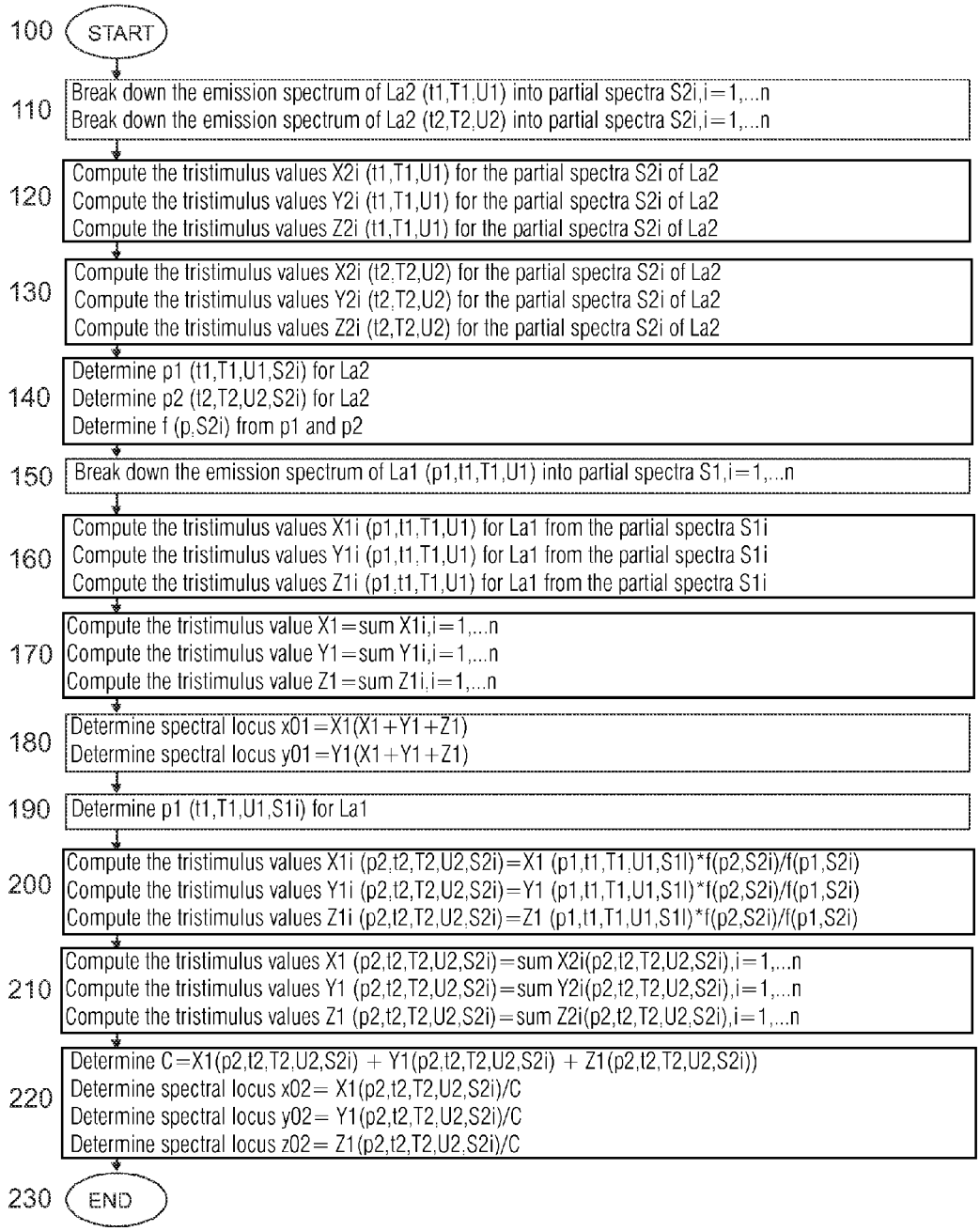
FIG. 5 shows a schematic illustration of a signal flow diagram for explaining the computation of the spectral locus shift on the basis of the method according to the invention.

In summary, it can therefore be stated that the dependencies illustrated in FIGS. 3 and 4 can be used as a basis for further method steps. These dependencies are particularly suitable for use in predicting a spectral locus shift for a specific Hg low-pressure discharge lamp L*a*1 depending on different parameters, in particular the time, the temperature or the operating voltage. The corresponding method is schematically outlined in the signal flow diagram in FIG. 5.

The method starts at step 100.

In the step 110, a calibration routine is started for an Hg low-pressure discharge lamp L*a*2, which is in particular of the same type as the Hg low-pressure discharge lamp L*a*1. For this purpose, the emission spectrum of the lamp L*a*2 is determined for the time point t1 using the temperature T1 and the voltage U1 at the output of the operating device, and at the time point t2 using the temperature T2 and the voltage U2 at the output of the operating device. The resulting spectra are then broken down into suitable spectral ranges S2*i*, such that the dependency of the emission intensities of these ranges on the Hg vapor pressure can be determined. The running index i starts at 1 and ends at n. By way of example, the spectrum is broken down into the spectral ranges of the individual luminophores and those of the visible Hg radiation at e.g. 405 nm and 435 nm.

In the step 120, the tristimulus values X2*i* are computed for the individual spectral ranges S2*i* of the Hg low-pressure discharge lamp L*a*2 for the time point t1 using the temperature T1 and the voltage U1 at the output of the operating device, the same applying likewise to the tristimulus values Y2 and Z2 using the identical operating conditions and the same spectral ranges.

In the step 130, the tristimulus values X2*i* are computed for the partial spectra S2*i* of the Hg low-pressure discharge lamp L*a*2 for the time point t2 using the temperature T2 and the voltage U2 at the output of the operating device, identical operating conditions being used for the tristimulus values Y2*i* and Z2*i*.

In the step 140, a variable p which is correlated with the Hg vapor pressure is determined from the selected spectral ranges. This is designated as p1 for the time point t1 using the temperature T1 and the voltage U1 at the output of the operating device, and is designated as p2 for the time point t2 using the temperature T2 and the voltage U2 at the output of the operating device. A mathematical function f(p) is then determined for the purpose of describing operating states that are situated between t1 and t2, T1 and T2, and U1 and U2.

In the step 150, the emission spectrum of the lamp L*a*1 is determined for the time point t1 using the temperature T1 and the voltage U1 at the output of the operating device. The resulting spectrum is then broken down into suitable spectral ranges S1*i*, said spectral ranges being identical to those of S2*i*. The running index i starts at 1 and ends at n, in the same way as that of S2*i*.

In step 160, the tristimulus values X1*i* for the partial spectra S1*i* of the Hg low-pressure discharge lamp L*a*1 are computed for the time point t1 using the temperature T1 and the voltage U1 at the output of the operating device. The tristimulus values Y1*i* and Z1*i* are likewise computed under the same operating conditions.

In the step 170, the tristimulus value X1 of the Hg low-pressure discharge lamp L*a*1 is computed for the time point t1 using the temperature T1 and the voltage U1 at the output of the operating device. This is done by means of summation of all tristimulus values X1*i* for the time point t1 using the temperature T1 and the voltage U1 at the output of the operating device, over the running index i=1 to n. The same applies for Y1 and Z1.

In step 180, the spectral locus x01 and y01 of the lamp L*a*1 is determined for the time point t1 using the temperature T1 and the voltage U1 at the output of the operating device, from the specified tristimulus values X1, Y1 and Z1.

In step 190, the variable p1 which is correlated with the Hg vapor pressure is determined from the spectral ranges S1*i* for the lamp L*a*1, for the time point t1 using the temperature T1 and the voltage U1 at the output of the operating device.

In the step 200, the tristimulus values X1*i* for the Hg low-pressure discharge lamp L*a*1 are then computed for the spectral ranges S1*i*, depending on the variable p2 which is correlated with the Hg vapor pressure, at the time point t2 using a temperature T2 and the voltage U2 at the output of the operating device. For this purpose, use is made of the tristimulus values X1*i* of the spectral ranges, measured in step 160 for the time point t1 using the temperature T1 and the voltage U1, and the ratio from a function f(p2, S2*i*) and a function f(p1, S2*i*) of the individual spectral ranges.

In step 210, the tristimulus value X1 of the Hg low-pressure discharge lamp L*a*1 is computed for the time point t2 using the temperature T2 and the voltage U2 at the output of the operating device. This is done by means of summation of all tristimulus values X1*i* for the time point t2 using the temperature T2 and the voltage U2 at the output of the operating device, over the running index i=1 to n. A corresponding computation follows for the tristimulus values Y1 and Z1.

In step 220, the spectral locus x01 and y01 is determined for the time point t2 using the temperature T2 and the voltage U2 at the output of the operating device, from the specified tristimulus values X1, Y1 and Z1.

The method ends in the step 230.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. An operating device for operating at least one Hg low-pressure discharge lamp which has a first and a second electrode coil, the operating device comprising:

an input for connecting a supply voltage;

an output for connecting the at least one Hg low-pressure discharge lamp;

a unit for providing a variable that is correlated with the Hg vapor pressure in the Hg low-pressure discharge lamp;

a microcontroller which is coupled to said unit for providing the variable that is correlated with the Hg vapor pressure and to the output of the operating device, and is configured to provide at the output a signal for operating the at least one Hg low-pressure discharge lamp, wherein the signal is comprises at least one lamp operating parameter which is dependent on the variable that is correlated with the Hg vapor pressure, wherein the unit for providing a variable that is correlated with the Hg vapor pressure in the at least one Hg low-pressure discharge lamp comprises at least one unit for capturing emission spectra of at least specifiable spectral ranges, wherein the unit for capturing emission spectra comprises at least one light receiving unit which is arranged in the beam path of the at least one Hg low-pressure discharge lamp.

2. The operating device as claimed in claim 1, wherein the at least one lamp operating parameter relates to the heating of at least one electrode coil of the at least one Hg low-pressure discharge lamp.

3. The operating device as claimed in claim 1, wherein the microcontroller is configured to determine the emission intensities of lines selected from a group of lines consisting of:

specifiable Hg lines;

Ar lines;

luminophore emission lines; and noble gas lines, and to analyze these at least for the purpose of determining the Hg vapor pressure of the at least one Hg low-pressure discharge lamp.

4. The operating device as claimed in claim 3, wherein the microcontroller is configured to determine the ratio of the emission intensity of the Hg line at at least one of 405 nm; 436 nm; 546 nm; 579 nm; and the Ar line at 764 nm, and to analyze these at least for the purpose of determining the Hg vapor pressure of the at least one Hg low-pressure discharge lamp.

5. The operating device as claimed in claim 4, wherein the microcontroller is configured to determine the ratio of the emission intensities of the Hg line at 436 nm and the Hg line at 405 nm, and to analyze these at least for the purpose of determining the Hg vapor pressure of the at least one Hg low-pressure discharge lamp.

6. The operating device as claimed in claim 1, wherein the unit for capturing emission spectra comprises a spectrometer.

7. The operating device as claimed in claim 1, wherein the unit for capturing emission spectra comprises at least one sensor which is suitable for at least one specifiable spectral range.

8. The operating device as claimed in claim 1, wherein the unit for capturing emission spectra is connected to the at least one Hg low-pressure discharge lamp.

9. The operating device as claimed in claim 1, wherein the microcontroller is configured to provide a signal, at the output of the operating device, for effecting an end-of-life shutdown.

10. The operating device as claimed in claim 1, wherein the microcontroller is further configured to activate at least one component that is relevant for the heat management of the at least one Hg low-pressure discharge lamp, depending on the Hg vapor pressure of the at least one Hg low-pressure discharge lamp.

11. The operating device as claimed in claim 1, wherein the unit for providing a variable that is correlated with the Hg vapor pressure in the at least one Hg low-pressure discharge lamp is configured to provide a variable that is correlated with the Hg vapor pressure of a plurality of Hg low-pressure discharge lamps, wherein an optical waveguide which is arranged in the beam path of the relevant Hg low-pressure discharge lamp is provided in each case as a light receiving unit for each Hg low-pressure discharge lamp, wherein each optical waveguide is coupled to the unit for capturing emission spectra.

12. A method for operating at least one Hg low-pressure discharge lamp which has a first and a second electrode coil, comprising an operating device having an input for connecting a supply voltage; an output for connecting the at least one Hg low-pressure discharge lamp; a unit for providing a variable that is correlated with the Hg vapor pressure in the Hg low-pressure discharge lamp; a microcontroller which is coupled to said unit for providing the variable that is correlated with the Hg vapor pressure and to the output of the operating device, and is configured to provide at the output a signal for operating the at least one Hg low-pressure discharge lamp, wherein the signal is comprises at least one lamp operating parameter which is dependent on the variable that is correlated with the Hg vapor pressure, the method comprising:

arranging at least one light receiving unit in the beam path of the at least one Hg low-pressure discharge lamp;

capturing the emission spectrum of at least specifiable spectral ranges by means of the at least one light receiving unit which is arranged in the beam path of the at least one Hg low-pressure discharge lamp; and from the captured emission spectrum, determining the variable that is correlated with the Hg vapor pressure of the at least one Hg low-pressure discharge lamp.

13. The method as claimed in claim 12, further comprising:

determining a first variable which is correlated with the Hg vapor pressure of a first Hg low-pressure discharge lamp at time point t1 using the temperature T1 and the voltage U1 at the output of the operating device;

determining at least one variable which is correlated with the spectral locus using the first variable that was correlated with the Hg vapor pressure of the first Hg low-pressure discharge lamp, at the time point t1 using the temperature T1 and the voltage U1 at the output of the operating device;

determining the variable which is correlated with the Hg vapor pressure of a second Hg low-pressure discharge lamp at the time point t2 using the temperature T2 and the voltage U2 at the output of the operating device; and computing at least one variable which is correlated with the spectral locus of the first Hg low-pressure discharge lamp at the time point t2 using the temperature T2 and the voltage U2, from the corresponding variable which was correlated with the spectral locus of the first Hg low-pressure discharge lamp at the time point t1 using the temperature T1 and the voltage U1, from the first variable which was correlated with the Hg vapor pressure of the first Hg low-pressure discharge lamp at the time point t1 using the temperature T1 and the voltage U1, and from the second variable which was correlated with the Hg vapor pressure of the second Hg low-pressure discharge lamp at the time point t2 using the temperature T2 and the voltage U2.

14. The operating device as claimed in claim 2, wherein the at least one lamp operating parameter relates to the heating selected from a group consisting of:

preheating;

continuous heating; and additional heating.

15. The operating device as claimed in claim 3, wherein the microcontroller is configured to determine the emission intensities of at least one of Kr and Xe lines.

16. The operating device as claimed in claim 10, wherein the microcontroller is further configured to activate at least one component that is relevant for the heat management of a Peltier element, a fan, a heating unit, or a cooling unit, depending on the Hg vapor pressure of the at least one Hg low-pressure discharge lamp.

17. The operating device as claimed in claim 11, wherein each optical waveguide is coupled to the unit for capturing emission spectra via a multiplexer.

* * * * *